US008897685B2

(12) United States Patent
Kubota

(10) Patent No.: US 8,897,685 B2
(45) Date of Patent: Nov. 25, 2014

(54) CLEANING SYSTEM, FIXING DEVICE, AND IMAGE FORMING APPARATUS INCORPORATING SAME

(75) Inventor: Keisuke Kubota, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 187 days.

(21) Appl. No.: 13/368,015

(22) Filed: Feb. 7, 2012

(65) Prior Publication Data

US 2012/0219335 A1 Aug. 30, 2012

(30) Foreign Application Priority Data

Feb. 28, 2011 (JP) ..... 2011-041820

(51) Int. Cl.
*G03G 15/20* (2006.01)

(52) U.S. Cl.
CPC .... *G03G 15/2075* (2013.01); *G03G 2215/2032* (2013.01)
USPC ..... 399/327; 399/122; 399/264; 399/326

(58) Field of Classification Search
USPC ..... 399/99, 122, 123, 264, 288, 326, 327
See application file for complete search history.

(56) References Cited

U.S. PATENT DOCUMENTS

| | | | | |
|---|---|---|---|---|
| 7,548,718 | B2 | 6/2009 | Kubota et al. | |
| 7,630,675 | B2 * | 12/2009 | Tateishi et al. | 399/327 |
| 7,945,198 | B2 | 5/2011 | Mitsuya et al. | |
| 8,023,850 | B2 | 9/2011 | Okamoto et al. | |
| 8,027,627 | B2 | 9/2011 | Okamoto et al. | |
| 2003/0002894 | A1 * | 1/2003 | Satoh | 399/324 |
| 2004/0247333 | A1 * | 12/2004 | Takahashi | 399/68 |
| 2006/0029441 | A1 * | 2/2006 | Ide et al. | 399/327 |
| 2007/0237554 | A1 | 10/2007 | Mitsuya et al. | |
| 2008/0013995 | A1 | 1/2008 | Kubota et al. | |
| 2008/0138103 | A1 * | 6/2008 | Nakano | 399/71 |

(Continued)

FOREIGN PATENT DOCUMENTS

| | | | |
|---|---|---|---|
| JP | 04056884 | A | 2/1992 |
| JP | 04180080 | A | 6/1992 |

(Continued)

OTHER PUBLICATIONS

Abstract of JP 11-024484 published Jan. 29, 1999.

(Continued)

*Primary Examiner* — David Gray
*Assistant Examiner* — Michael Harrison
(74) *Attorney, Agent, or Firm* — Harness, Dickey & Pierce, P.L.C.

(57) ABSTRACT

A fixing device includes a rotary fuser member, a rotary pressure member, and a cleaning system. The rotary fuser member is subjected to heating. The rotary pressure member is opposite the fuser member. The fuser member and the pressure member are pressed against each other to form a fixing nip therebetween through which a recording medium is conveyed as the fuser member and the pressure member rotate together. The cleaning system cleans the pressure member, and includes a cleaning web, a web supply mechanism, and a controller. The cleaning web at least partially contacts the pressure member to wipe the pressure member. The cleaning web is mounted on the web supply mechanism to be released into contact with the pressure member. The controller is operatively connected with the web supply mechanism to control an amount of supply of the cleaning web.

17 Claims, 4 Drawing Sheets

(56) References Cited

U.S. PATENT DOCUMENTS

| | | | |
|---|---|---|---|
| 2008/0170896 | A1 | 7/2008 | Kubota et al. |
| 2009/0274477 | A1 | 11/2009 | Okamoto et al. |
| 2009/0274494 | A1 | 11/2009 | Okamoto et al. |
| 2009/0274495 | A1 | 11/2009 | Okamoto et al. |
| 2009/0274496 | A1 | 11/2009 | Okamoto et al. |
| 2009/0274497 | A1 | 11/2009 | Okamoto et al. |
| 2009/0274498 | A1 | 11/2009 | Okamoto et al. |
| 2011/0311249 | A1 | 12/2011 | Kubota et al. |
| 2012/0087688 | A1 | 4/2012 | Kubota |

FOREIGN PATENT DOCUMENTS

| | | | |
|---|---|---|---|
| JP | 05257405 | A | 10/1993 |
| JP | 11024484 | A | 1/1999 |
| JP | 2002258657 | A | 9/2002 |
| JP | 2003057986 | A | 2/2003 |
| JP | 2005024619 | A | 1/2005 |
| JP | 2005128380 | A | 5/2005 |
| JP | 2008040053 | A | 2/2008 |

OTHER PUBLICATIONS

Abstract of JP 2003-057986 published Feb. 28, 2003.
Abstract of JP 2005-128380 published May 19, 2005.
Abstract of JP 2008-040053 published Feb. 21, 2008.
Abstract of JP 2002-258657 published Sep. 11, 2002.
Abstract of JP 2005-024619 published Jan. 27, 2005.
Abstract of JP 05-257405 published Oct. 8, 1993.
Abstract of JP 04-180080 published Jun. 26, 1992.
Abstract of JP 04-056884 published Feb. 24, 1992.

* cited by examiner

CLEANING SYSTEM, FIXING DEVICE, AND IMAGE FORMING APPARATUS INCORPORATING SAME

CROSS-REFERENCE TO RELATED APPLICATIONS

This patent application claims priority pursuant to 35 U.S.C. §119 to Japanese Patent Application No. 2011-041820, filed on Feb. 28, 2011, the entire disclosure of which is hereby incorporated by reference herein.

BACKGROUND OF THE INVENTION

1. Technical Field

The present invention relates to a cleaning system, a fixing device, and an image forming apparatus incorporating the same, and more particularly, to a fixing device that fixes a toner image in place on a recording medium with heat and pressure, a cleaning system for use in such a fixing device, and an electrophotographic image forming apparatus which employs a fixing device with a cleaning capability.

2. Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium.

Various types of fixing processes are known in the art, among which a pressure-assisted thermal fixing process is widely accepted. This type of fixing device employs a pair of generally cylindrical members, such as a looped belt and a roller, one having a heat source such as a halogen heater or the like for fusing toner ("fuser member") and the other being pressed against the heated one ("pressure member"), which together form a heated area of contact called a fixing nip through which a recording medium is passed to fix a toner image onto the medium under heat and pressure.

One problem associated with the pressure-assisted thermal fixing process is undesired transfer or offset of toner particles to a fuser member. Ideally, a toner image after fixing permanently adheres to a recording medium on which it is printed. However, toner offset often takes place, for example, due to improper heating at the fixing nip, where adhesion between the fuser member and the fused toner exceeds that between the recording medium and the fused toner, causing a small portion of toner to transfer from the recording medium to the fuser member.

Two types of toner offset are known: cold offset and hot offset. Cold offset occurs where insufficient heating at the fixing nip causes the toner image to fuse only superficially, leaving an inner portion of the toner layer in a loose, unfused state, which can partially crush up and eventually migrate to the fuser member. Such toner migration is typically accompanied by concomitant image defects in which the toner image, which is not completely fused or fixed, easily rubs off the printed surface being output. Hot offset, on the other hand, occurs where excessive heating at the fixing nip affects viscoelasticity of the toner image being fused, so that the toner exhibits a high adhesion to the fuser member surpassing a cohesive force of toner particles, resulting in partial migration of toner to the fuser member.

The problem described above, in particular, cold offset, is pronounced where printing is performed using specific, newly developed types of toner, including those formulated with extremely small particle sizes, or those with spherically shaped particles typically produced through polymerization, which are increasingly employed in modern electrophotographic printers to meet ever-increasing demands for high-quality imaging processes. Compared to those with varying sizes and aspherical shapes, the small-sized, spherically-shaped toner is susceptible to causing cold offset since it does not easily conduct heat, and therefore is difficult to fuse and melt, particularly when used to print on a rough, irregular surface of non-coated paper.

Not surprisingly, toner offset detracts from image quality due not only to a lack of toner migrating from the recording medium, but also to soiling of the resulting print with offset toner which, once transferred from a recording medium onto the fixing member, is again transferred to another recording medium that enters the fixing nip subsequent to the foregoing recording medium.

Various cleaning techniques have been proposed to keep the fuser member clean of toner particles and other contaminants, which employ a cleaning web, such as an elongated strip of unwoven fabric, to wipe the surface of the fuser member. In a typical configuration, the cleaning web is drawn from a replaceable supply roller and pulled by and wound on a takeup roller, with a tension roller elastically biased against the fuser member to form a cleaning nip therebetween, through which the web is passed to press against the fuser member.

For example, one such technique provides a web cleaning system that continuously cleans a fuser member with a cleaning web during operation of a fixing device. According to this method, the cleaning web is taken up by a takeup roller upon completion of each print job to constantly supply a new, unused sufficiently large area of the web to the cleaning nip. Such constant supply of new cleaning web prevents formation of a gap between the fuser member and the web, which, if created, would permit small spherical toner particles to escape from being wiped off at the cleaning nip.

Although capable of effectively cleaning the fuser member, this cleaning method results in wasteful use of the cleaning web, which is detrimental to environment. Also, accelerated consumption of the cleaning web requires frequent service for the cleaning system and thus eventually increases maintenance cost of the image forming apparatus.

Another technique proposes a control method for a web cleaning system which controls supply of a cleaning web to the cleaning nip. According to this method, the controller adjusts an amount by which the cleaning web is taken up depending on image density (i.e., a ratio of a toner-covered area to an entire image area) of a specific print job processed through the fixing nip. Although designed to prevent an unnecessary, superfluous supply of cleaning web upon processing of relatively light or low density images, however, such control does not work properly because the image density is not always proportional to the amount of toner offset to the fuser member.

Still another technique proposes a web cleaning system employing a cleaning web directed to a pressure member opposite a fuser member, which indirectly cleans the fuser member as the cleaning web wipes the pressure member which collects toner retransferred from the fuser member. According this method, providing the cleaning web to the pressure member, instead of the fuser member, prevents the cleaning web from damaging the surface of the fuser member facing the printed surface of a recording medium image, which would otherwise cause imaging defects, such as vertical straight lines appearing on the printed page.

BRIEF SUMMARY OF THE INVENTION

Exemplary aspects of the present invention are put forward in view of the above-described circumstances, and provide a novel fixing device.

In one exemplary embodiment, the fixing device includes a rotary fuser member, a rotary pressure member, and a cleaning system. The rotary fuser member is subjected to heating. The rotary pressure member is opposite the fuser member. The fuser member and the pressure member are pressed against each other to form a fixing nip therebetween through which a recording medium is conveyed as the fuser member and the pressure member rotate together. The cleaning system cleans the pressure member, and includes a cleaning web, a web supply mechanism, and a controller. The cleaning web at least partially contacts the pressure member to wipe the pressure member. The cleaning web is mounted on the web supply mechanism to be released into contact with the pressure member. The controller is operatively connected with the web supply mechanism to control an amount of supply of the cleaning web depending on a rotational distance traveled by the pressure member in direct contact with the fuser member.

Other exemplary aspects of the present invention are put forward in view of the above-described circumstances, and provide a novel image forming apparatus incorporating a fixing device.

Still other exemplary aspects of the present invention are put forward in view of the above-described circumstances, and provide a novel cleaning system for use in a fixing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
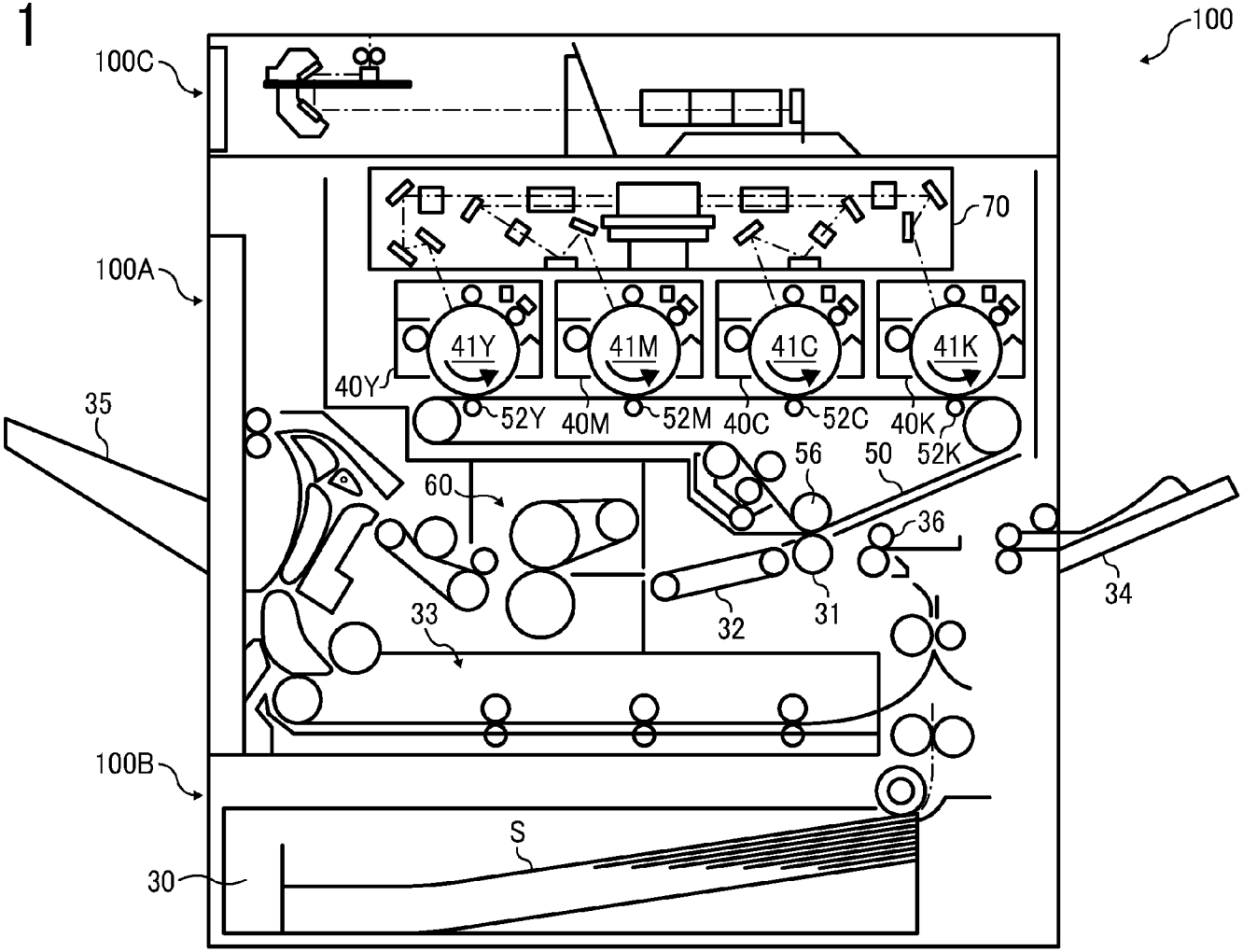
FIG. 1 schematically illustrates an image forming apparatus incorporating a fixing device according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 incorporating a fixing device 60 according to this patent specification.

As shown in FIG. 1, the image forming apparatus 100 is a digital color imaging system that can print a color image on a recording medium such as a sheet of paper S according to image data, consisting of a generally upper, printer section 100A, and a generally lower, sheet feeding section 100B combined together to form a freestanding unit, on top of which may be deployed an appropriate image scanner 100C for capturing image data from an original document.

The printer section 100A comprises a tandem color printer that forms a color image by combining images of yellow, magenta, and cyan (i.e., the complements of three subtractive primary colors) as well as black, consisting of four electrophotographic imaging stations 40Y, 40M, 40C, and 40K arranged in series substantially laterally along the length of an intermediate transfer belt 50, each forming an image with toner particles of a particular primary color, as designated by the suffixes "Y" for yellow, "M" for magenta, "C" for cyan, and "K" for black.

Each imaging station 40 includes a drum-shaped photoconductor 41 rotatable counterclockwise in the drawing, having its outer, photoconductive surface exposed to an exposure device 70 while surrounded by various pieces of imaging equipment, such as a charging device, a development device accommodating toner of the associated primary color, a primary transfer device incorporating an electrically biased, primary transfer roller 52, a cleaning device for the photoconductive surface, etc., which work in cooperation to form a primary toner image on the photoconductor 41 for subsequent transfer to the intermediate transfer belt 50 at a primary transfer nip defined between the photoconductive drum 41 and the primary transfer roller 52.

The intermediate transfer belt 50 is trained around multiple support rollers to rotate clockwise in the drawing, passing through the four primary transfer nips sequentially to carry thereon a multi-color toner image toward a secondary transfer nip defined between a secondary transfer roller 31 and a backup roller 56, at which the toner image is transferred to a recording sheet S fed from the sheet feeding section 100B.

The sheet feeding section 100B includes one or more sheet trays 30 each accommodating a stock of recording sheets S, as well as a sheet conveyance mechanism, including multiple rollers, guide plates, etc., which together define a sheet conveyance path for conveying a recording sheet S from the sheet tray 30 or a manual input sheet tray 34, between a pair of registration rollers 36, then through the secondary transfer nip, and then through the fixing device 60 which fixes the toner image in place on the recording sheet S with heat and pressure. A detailed description of the fixing device 60 and its associated structure will be given later with reference to FIG. 2 and subsequent drawings.

Downstream of the fixing device 60 along the sheet conveyance path is a sheet reversing unit 33 that reverses the recording sheet S after fixing to reintroduce it into the sheet conveyance path where required, as well as an output sheet tray 35 disposed outside the apparatus body to accommodate a finalized print for user pickup.

During operation, each imaging station 40 rotates the photoconductor drum 41 clockwise in the drawing to forward its photoconductive surface to a series of electrophotographic processes, including charging, exposure, development, transfer, and cleaning, in one rotation of the photoconductor drum 41.

First, the photoconductive surface is uniformly charged to a specific polarity by the charging device and subsequently exposed to a modulated laser beam emitted from the exposure device 70. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer nip between the drum 41 and the roller 52 which electrostatically transfers the primary toner image from the photoconductor 41 to the intermediate transfer belt 50. After primary transfer, the photoconductive surface is cleaned of residual toner, followed by discharging residual charge to initialize the photoconductor 41 for a subsequent imaging cycle.

The electrophotographic processes described above may be performed in not all of the four imaging stations 40Y, 40M, 40C, and 40K. For example, a monochrome image of a particular primary color is formed with only a single imaging station 40 dedicated to the specific primary color, whereas a bi-color or tri-color image is formed with selected two or three imaging stations. In particular, a black-and-white image may be formed with only the black imaging station 40K instead of activating all the four imaging stations.

As the multiple imaging stations 40 sequentially produce toner images of different colors at the four transfer nips along the belt travel path, the primary toner images are superimposed one atop another to form a single multicolor image on the moving surface of the intermediate transfer belt 50 for subsequent entry to the secondary transfer nip between the secondary transfer roller 31 and the backup roller 56.

Meanwhile, the sheet conveyance mechanism picks up a recording sheet S from atop the sheet stack in the sheet tray 30 or the manual input tray 34 to introduce it between the pair of registration rollers 36 being rotated. Upon receiving the incoming sheet S, the registration rollers 36 stop rotation to hold the sheet S therebetween, and then advance it in sync with the movement of the intermediate transfer belt 50 to the secondary transfer nip.

At the secondary transfer nip, the multicolor image is transferred from the belt 50 to the recording sheet S, which is then introduced into the fixing device 60 to fix the toner image in place under heat and pressure. The recording sheet S, thus having its first side printed, is forwarded to a sheet diverter that selectively directs the incoming sheet S to the output sheet tray 35 where simplex printing is intended, or to the sheet reversing unit 33 where duplex printing is intended.

For duplex printing, the sheet reversing unit 33 turns over the incoming sheet S for reentry to the sheet conveyance path, wherein the reversed sheet S again undergoes electrophotographic imaging processes including registration through the registration roller pair 36, secondary transfer through the secondary transfer nip, and fixing through the fixing device 60 to form another print on its second side opposite the first side.

Upon completion of simplex or duplex printing, the recording sheet S is output to the output sheet tray 35 for stacking outside the apparatus body, which completes one operational cycle of the image forming apparatus 100.

Figure 2:
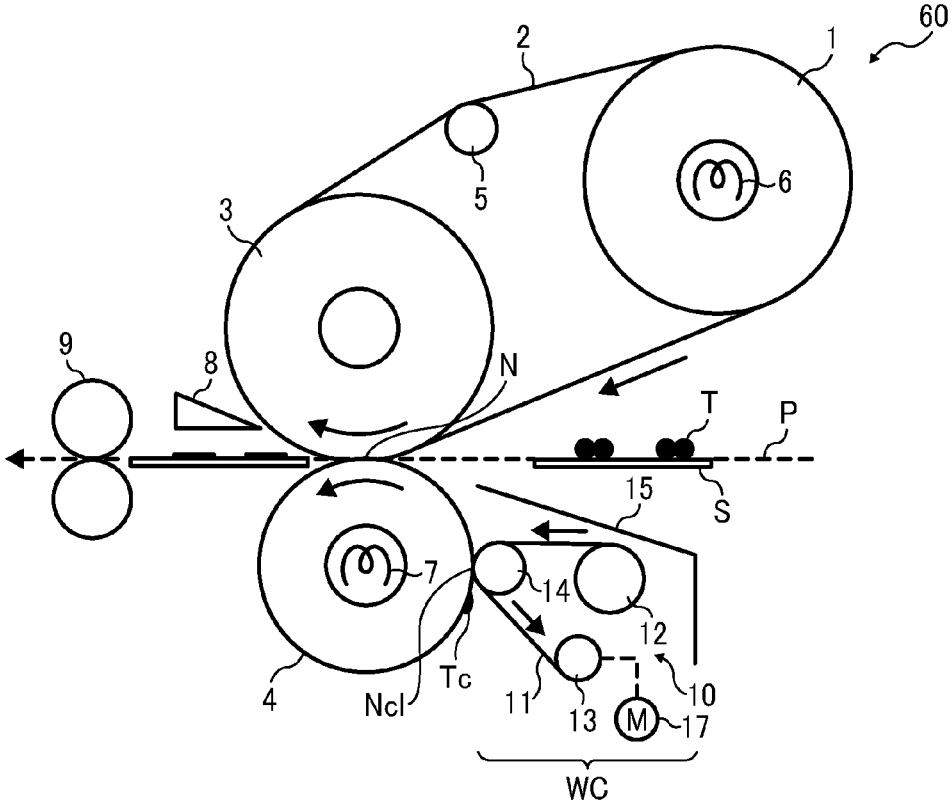
FIG. 2 is an end-on, axial cutaway view schematically illustrating the fixing device according to one embodiment of this patent specification.

FIG. 2 is an end-on, axial cutaway view schematically illustrating the fixing device 60 according to one embodiment of this patent specification.

As shown in FIG. 2, the fixing device 60 comprises a belt-based fixing assembly, including an internally heated, heat roller 1, a motor-driven fuser roller 3 parallel to the heat roller 1, a rotatable, endless fuser belt 2 entrained around the heat roller 1 and the fuser roller 3, and a rotatable pressure roller 4 parallel to the fuser roller 3. Heaters 6 and 7, such as halogen lamps, are provided in the heat roller 1 and the pressure roller 4, respectively. The pressure roller 4 presses against the fuser roller 3 via the fuser belt 2 to form a fixing nip N therebetween through which a recording sheet S is conveyed along a sheet conveyance path P as the fuser roller 3 rotates to in turn rotate the fuser belt 2 and the pressure roller 4.

Also included in the fixing device 60 are a tension roller 5 disposed between the heat roller 1 and the fuser roller 3 inside the loop of the fuser belt 2, a sheet guide 15 upstream from the fixing nip N along the sheet conveyance path, a sheet separator 8 adjacent to the fixing nip N, and a pair of conveyor rollers 9 downstream from the fixing nip N along the sheet conveyance path P.

Components of the fixing device 60 are contained in an enclosure housing for removable installation in the image forming apparatus 100. In particular, the heat roller 1, the fuser roller 3, and the pressure roller 4 extend parallel to each other in an axial, longitudinal direction, each having a rotational axis thereof rotatably affixed to the enclosure housing. Also, the roller internal heaters 6 and 7 are held stationary on the enclosure housing.

Specifically, in the present embodiment, the fuser belt 2 comprises an endless belt formed of any suitable material that conducts heat. For example, in the present embodiment, the belt 2 is formed of a substrate of polyimide (PI) approximately 90 mm thick, upon which an anti-offset coating, such as perfluoroalkoxy (PFA), is deposited to prevent undesired adhesion of toner to the belt surface. The fuser belt 2 is entrained around the heat roller 1 and the fuser roller 3 while subjected to heating by the heat roller 1 internally heated with the heater 6.

The fuser roller 3 and the pressure roller 4, disposed parallel to each other, each comprises a cylindrical body of any suitable material, such as rubber. The pressure roller 4 is equipped with a biasing mechanism which presses the roller 4 toward the fuser roller 3, or more precisely, toward the central axis of the roller 3, so as to establish the fixing nip N during operation, and releases pressure on the roller 4 to destablish the fixing nip N where desired, e.g., for removing jammed paper.

The tension roller 5 may be any suitable tubular or cylindrical body elastically biased against the fuser belt 2 to generate or maintain a proper tension in the belt 2. For example, in the present embodiment, the tension roller 5 is a tubular elongated piece of aluminum.

The fuser roller 3 is equipped with a rotary drive mechanism held stationary on the enclosure housing for imparting torque to the rotatable body. For example, in the present embodiment, the rotary drive of the roller 3 includes a motor connected to the roller rotational axis via a reduction gear train to rotate the roller 3 at a given rotational speed, which in turn rotate the pressure roller 4 and the fuser belt 2 pressing against the roller 3 at the same rotational speed. In the example depicted in FIG. 1, rotation of the fuser roller 3 is clockwise, causing the fuser belt 2 to co-rotate clockwise and the pressure roller 4 counterclockwise, so as to convey the recording sheet S from right to left through the fixing nip N.

The heaters 6 and 7 used in the fixing device 20 may be formed of any suitable heat source, including electrical resistance heater, such as a halogen heater or a ceramic heater, as well as electromagnetic induction heater (IH), a resistance heat generator, a carbon heater, and the like.

During operation, the heat roller 1 internally heated with the heater 6 conducts heat to the fuser belt 2, whereas the motor-driven fuser roller 3 rotates to in turn rotate the fuser belt 2 and the pressure roller 4 in unison and in opposite rotational directions.

Then, a recording sheet S bearing an unfixed, powder toner image T enters the fixing device 20 along the sheet conveyance path P. As the rotary fixing members rotate together, the recording sheet S, guided by the guide plate 15, passes through the fixing nip N wherein heat from the fuser belt 2 causes toner particles to fuse and melt, while pressure from the pressure roller 4 causes the molten toner to settle onto the sheet surface, thereby fixing the toner image T in place.

After fixing, the recording sheet S exits the fixing nip N with the sheet separator 8 separating the sheet leading edge off the fuser belt 2, followed by the conveyor roller pair 9 forwarding the outgoing sheet S to outside the fixing device 60.

With continued reference to FIG. 2, the fixing device 60 is shown with a web cleaning system WC adjacent to the pressure roller 4, including a cleaning web 11 at least partially contacting the pressure roller 4 to wipe the pressure roller 4, and a web supply mechanism 10 on which the cleaning web 11 is mounted to be released into contact with the pressure roller 4. The cleaning system WC serves to clean the pressure roller 4 where the roller surface becomes soiled with toner particles Tc or other contaminants originating from the recording sheet S, which undesiredly transfer or offset from the sheet S to the fuser belt 2 and eventually retransfer to the pressure roller 4 through the fixing nip N.

Specifically, in the present embodiment, the cleaning web 11 comprises any suitable material with its width, length, and thickness dimensioned to provide adequate cleaning of the pressure member.

The web supply mechanism 10 includes a supply roller 12 around which a new, unused length of cleaning web 11 is wrapped and stored for future release, a takeup roller 13 to which a free, distal end of the cleaning web 11 is attached, and a tension roller 14 pressing against the pressure roller 4 to form a cleaning nip Nc1 therebetween, through which the cleaning web 11 is passed under pressure to rub against the roller 4 as the roller 4 rotates in its rotational direction. The takeup roller 13 is equipped with a stepper motor 17 connected with the roller rotational axis via a gear train to rotate the roller 13 with a constant torque, which unreels the web 11 from the supply roller 12 by a predetermined amount upon each rotation of the roller 13.

More specifically, in the present embodiment, the cleaning web 11 is an elongated strip of nonwoven fabric, such as aromatic polyamide, impregnated with a release agent, such as silicone oil. The tension roller 14 comprises a cylindrical shaft covered by an elastic material, such as foamed silicone rubber, equipped with a suitable biasing mechanism, such as a spring, to press the web 11 against the pressure roller 3 at the cleaning nip Nc1. The cleaning nip Nc1 extends, for example, to approximately 3 mm to approximately 6 mm long in a circumferential direction of the pressure roller 4.

Figure 3:
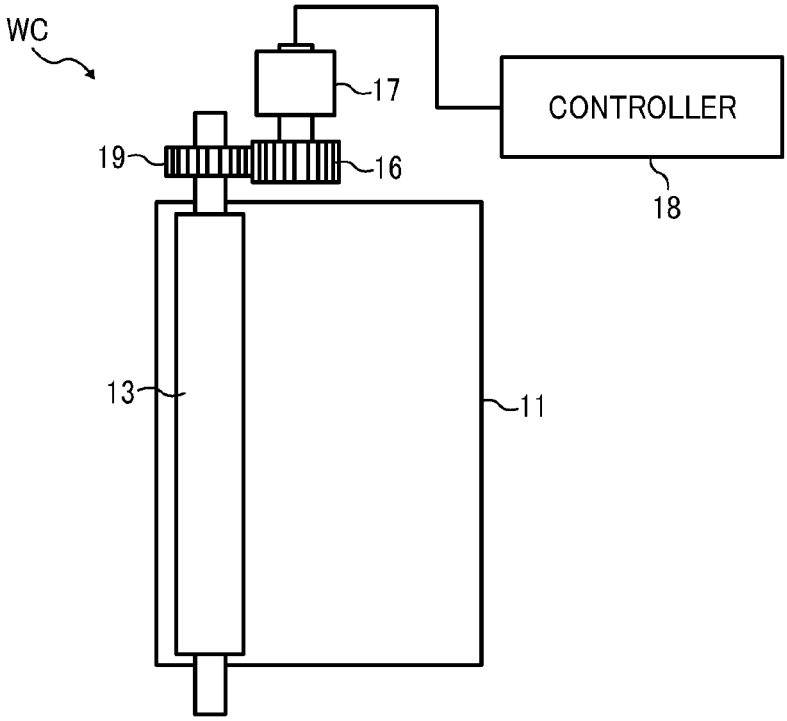
FIG. 3 is a plan, bottom view of a web cleaning system included in the fixing device of FIG. 2.

With additional reference to FIG. 3, which is a plan, bottom view of the web cleaning system WC of FIG. 2, the cleaning system WC is shown further including a controller 18 operatively connected with the web supply mechanism 10 to control an amount of supply of the cleaning web 11 to the cleaning nip Nc1.

Specifically, in the present embodiment, the controller 18 comprises a central processing unit (CPU) and its associated memory devices which constitute motor drive circuitry to control operation of the stepper motor 17. The stepper motor 17 has its rotational axis connected with a reduction gear 16 meshing another, driven gear 19 engaging the rotational axis of the takeup roller 13.

To supply a new, unused portion of the cleaning web 11 to the cleaning nip N, the controller 18 intermittently activates the stepper motor 17 whenever a predetermined period of time has elapsed since preceding activation of the motor 17, or whenever the fixing device 60 processes a predetermined number of recording sheets S through the fixing nip N. In the present embodiment, for example, the time interval between two successive activations of the stepper motor 17 is approximately 15 seconds.

Upon activation, the stepper motor 17 rotates in discrete steps or angles of rotation. As the stepper motor 17 rotates or steps, the meshing gears 16 and 19 transmit torque from the stepper motor 17 to the takeup roller 13, which causes the web 11 to unreel by a constant amount proportional to an amount of rotation of the takeup roller 13 during a single step of the stepper motor 17. The takeup amount of the web 11 per each step of the motor 17, which is determined by a reduction ratio of the gear train, may be set to, for example, approximately 0.82 mm.

The inventor has recognized that, in a cleaning system that employs a cleaning web for wiping a pressure member, the rate of usage of the cleaning web, as represented by the amount of toner and other contaminants collected by the cleaning web, changes depending on variable factors that vary among individual print jobs submitted.

Specifically, the amount of contaminants collected by the cleaning web per unit of time is substantially proportional to a page-to-page interval between consecutive recording media processed successively through the fixing nip, which dictates a circumferential, rotational distance traveled by the pressure member in direct contact with the fuser member, i.e., without a recording medium intervening between the adjoining surfaces of the fuser and pressure members.

That is, the longer the page-to-page interval, the longer is the duration of direct contact between the pressure member and the fuser member, which allows more offset toner to transfer from the fuser member to the pressure member. As a result, the amount of contaminants collected by the cleaning web from the pressure member increases where printing is performed with a longer page-to-page distance, and decreases where printing is performed with a shorter page-to-page distance.

Since the page-to-page interval is primarily determined by the size or length of recording medium in the direction of conveyance through the fixing nip as well as the operational cycle with which the recording medium is processed, variations in these factors translate into variations in the rate of usage of the cleaning web.

Further, in addition to the size of recording medium, the rate of usage of the cleaning web may be influenced by several other factors, such as the mode of operation in which each specific printing job is executed, the texture of recording medium in use, insofar as variations in such factors are accompanied by concomitant changes in the tendency of the pressure member to collect toner particles at the fixing nip.

To properly supply the cleaning web 11 in accordance with the rate of usage of the cleaning web varying under different operational conditions, the web cleaning system WC of the fixing device 60 according to this patent specification can control an amount of supply of the cleaning web 11 depending on a circumferential, rotational distance traveled by the pressure roller 4 in direct contact with the fuser belt 2, that is, without a recording sheet S intervening between the adjoining surface of the roller 4 and the belt 2.

Specifically, in the present embodiment, the controller 18 adjusts a period of activation time during which the stepper motor 17 is activated to release the cleaning web 11, so as to control an amount by which the cleaning web 11 is supplied to the cleaning nip Nc1 upon each activation of the stepper motor 17 depending on a size, or more precisely, length of the recording sheet S in a conveyance direction in which the sheet is conveyed through the fixing nip N, as well as a pickup cycle of the recording sheet S (i.e., a predetermined duration of time during which the pressure roller 4 and the fuser belt 2 rotate together at a constant linear process speed for forwarding the sheet through the fixing nip N).

Figure 4:
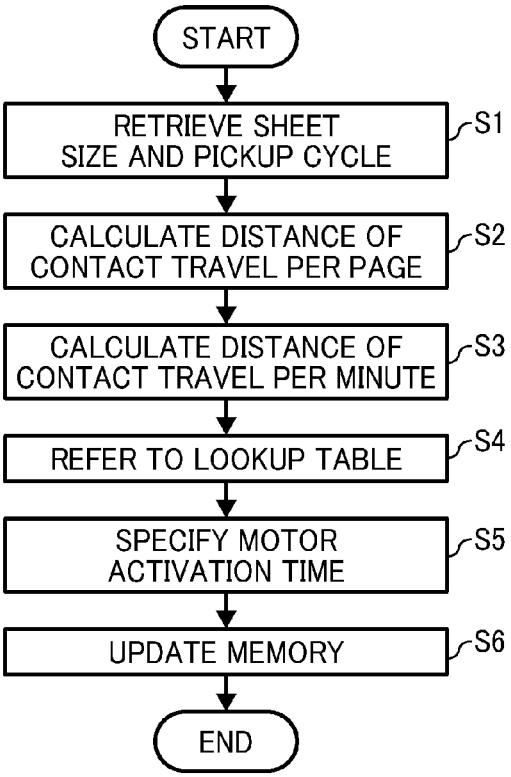
FIG. 4 is a flowchart illustrating an operation of a web cleaning system controller provided in the fixing device of FIG. 2.

FIG. 4 is a flowchart illustrating an operation of the controller 18 of the web cleaning system WC provided in the fixing device 60 of FIG. 2.

As shown in FIG. 4, to print or duplicate an image on a recording sheet S, in step S1, the controller 18 initially accesses its associated memory device to retrieve a length of the recording sheet S in the sheet conveyance direction and a pickup cycle of the recording sheet S.

In step S2, with the operational parameters thus obtained, the controller 18 then calculates a rotational distance traveled per page by the pressure roller 4 in direct contact with the fuser belt 2, as given by the following equation Eq. 1:

$$X=C*V-L \quad \text{Eq. 1}$$

where "X" denotes the rotational distance traveled per page by the pressure roller 4 during rotation in direct contact with the fuser belt 2; "C" denotes the pickup cycle of the recording sheet S; "V" denotes the linear process speed for processing the recording sheet S; and "L" denotes the length of the recording sheet S in the sheet conveyance direction.

In step S3, based on the calculated distance of contact travel per page, the controller 18 further calculates a rotational distance traveled per minute by the pressure roller 4 in direct contact with the fuser belt 2, as given by the following equation Eq. 2:

$$Y=(N-1)*X \quad \text{Eq. 2}$$

where "N" denotes the number of recording sheets S processed each minute in the fixing device 60, and "X" denotes the rotational distance traveled by the pressure roller 4 in direct contact with the fuser belt 2.

Table 1 below provides an example of specific variables X and Y calculated for different types of recording sheets, each of which has a specific length in the conveyance direction and is processed with a specific pickup cycle.

TABLE 1

| Sheet size | B5-width | A4-width | A3-height | Letter-width with +0.1 tolerance | A4-height with +0.1 tolerance | B4-height with +0.1 tolerance |
|---|---|---|---|---|---|---|
| Length in conveyance direction (mm) | 182 | 210 | 420 | 216 | 297.1 | 364.1 |
| Pickup cycle (msec) | 664 | 664 | 1168 | 852 | 996 | 1168 |
| Distance of contact travel per page (mm) | 110.1 | 82.1 | 93.8 | 158.8 | 141.1 | 149.7 |
| Distance of contact travel per minute (mm) | 9800.1 | 7308.1 | 4691.9 | 10958.6 | 8323.1 | 7486.9 |

As can be seen from Table 1, in the present embodiment, the distance traveled by the pressure roller 4 in direct contact with the fuser belt 2 generally increases with a shorter length of the recording sheet S in the conveyance direction and a longer pickup cycle with which the sheet S is processed. In particular, among three sizes of copy paper most frequently employed in a Japanese office environment, that is, B5-width, A4-width, and A3-height, listed above, processing of B5-width paper requires the longest distance traveled by the pressure roller 4 in direct contact with the fuser belt 2.

In step S4, the controller 18 refers to a lookup table which associates a specific rotational distance Y traveled per minute by the pressure roller 4 in direct contact with the fuser belt 2 with an optimal period of activation time during which the stepper motor 17 is activated to yield a corresponding amount of supply of the cleaning web 11 per each activation of the stepper motor 17. An example of such lookup table is provided in Table 2 below.

TABLE 2

| Distance of contact travel per minute (mm) | Motor activation time (sec) |
|---|---|
| $Y \leq 4600$ | 5 (default) |
| $4600 < Y \leq 6000$ | 6 |
| $6000 < Y \leq 8000$ | 7 |
| $8000 < Y \leq 10000$ | 8 |
| $10000 < Y$ | 9 |

Applying the specific values Y presented in Table 1 to the lookup table presented in Table 2 gives optimal values of motor activation time for the types of copy paper, that is, 8 seconds for B5-width; 7 seconds for A4-width; 6 seconds for A3-height; 9 seconds for letter-width; 8 seconds for A4-height; and 7 seconds for B4-height.

In step S5, according to the lookup table, the controller 18 specifies a specific activation time with which to drive the stepper motor 17. Finally, in step S6, the controller 18 updates its associated memory with the specified activation time for driving the stepper motor 17, so as optimize the amount of supply of the cleaning web 11 according to the size and pickup cycle of the recording sheet S being used.

Figure 5:
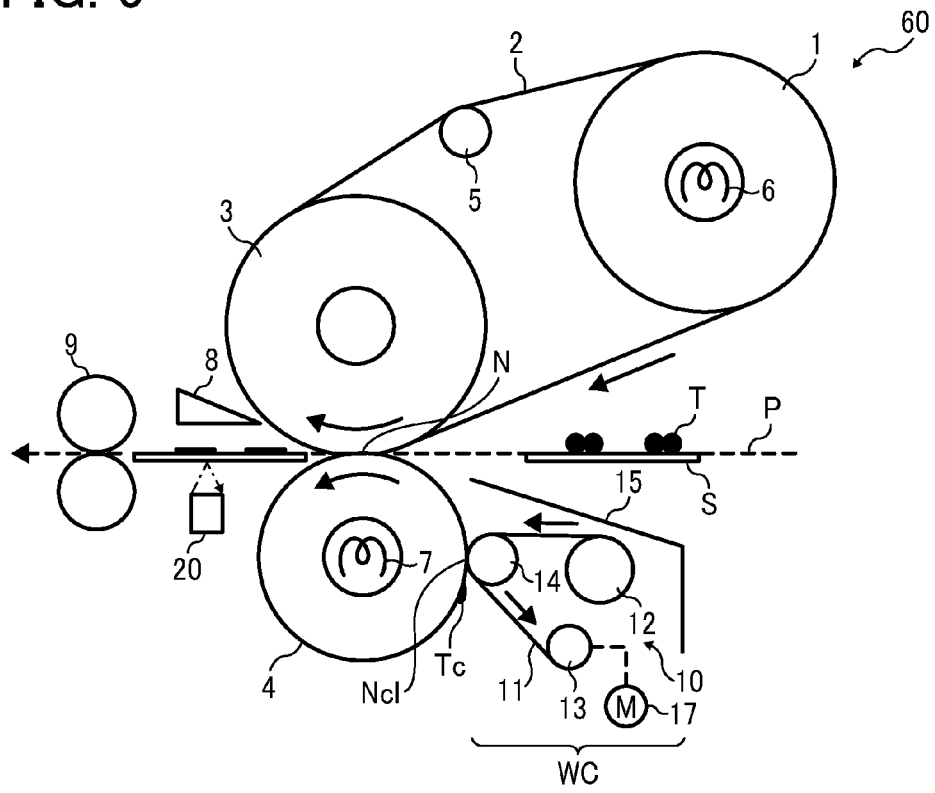
FIG. 5 is an end-on, axial cutaway view schematically illustrating the fixing device according to further embodiment of this patent specification.

FIG. 5 is an end-on, axial cutaway view schematically illustrating the fixing device 60 according to further embodiment of this patent specification.

As shown in FIG. 5, the present embodiment is similar to that depicted primarily with reference to FIG. 2, except that the fixing device 60 further includes a sensor 20 operatively connected with the controller 18 and directed to a measurement point along the sheet conveyance path P to signal the controller 18 where the recording sheet S passes through the measurement point.

Specifically, in the present embodiment, the sensor 20 is directed to a fixed measurement point downstream from the fixing nip N along the sheet conveyance path P. The measurement point may be located at any suitable position along the sheet conveyance path P, either downstream or upstream from the fixing nip N, such as, for example, at an entrance of the fixing device 60.

During operation, the sensor 20 detects where leading and trailing edges of a single recording sheet S reach the measurement point after exiting the fixing nip N, which indicates the distance between the leading and training edges of the sheet S, i.e., the length of the sheet S in the conveyance direction. The results of detection by the sensor 20 are transmitted to the controller 18, which accordingly calculates the rotational distance of the pressure roller 4 in direct contact with the fuser belt 2.

Figure 6:
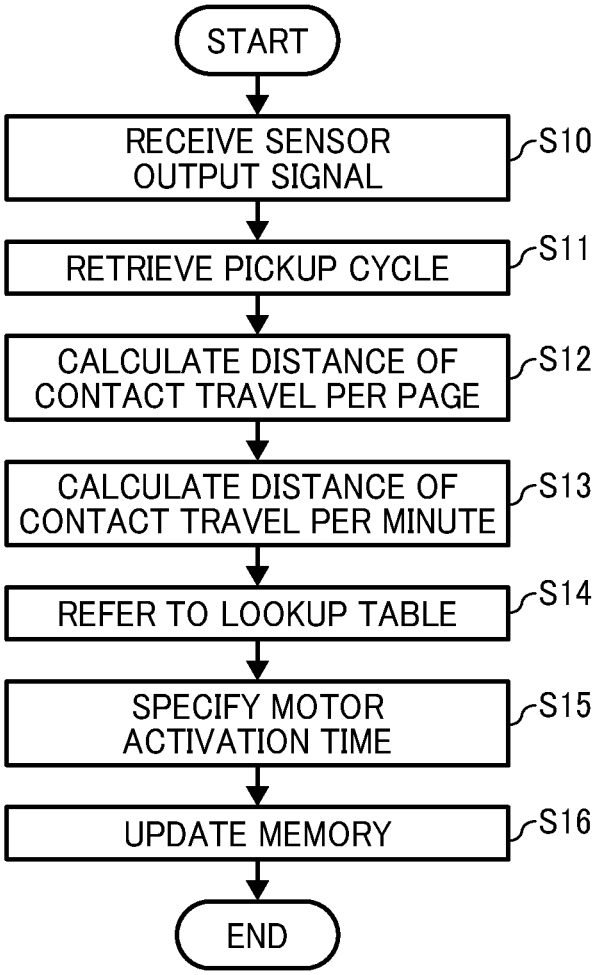
FIG. 6 is a flowchart illustrating an operation of a web cleaning system controller provided in the fixing device of FIG. 5.

FIG. 6 is a flowchart illustrating an operation of the controller 18 of the web cleaning system WC provided in the fixing device 60 of FIG. 5.

As shown in FIG. 6, to print or duplicate an image on a recording sheet S, in step S10, the controller 18 receives a detection signal output from the sensor 20 indicating a measured length of the recording sheet S in the sheet conveyance direction. Then, in step S11, the controller 18 accesses its associated memory device to retrieve a pickup cycle of the recording sheet S.

In step S12, with the operational parameters thus obtained, the controller 18 then calculates a rotational distance traveled per page by the pressure roller 4 in direct contact with the fuser belt 2. Such calculation may be performed by, for example, using the equation Eq. 1.

In step S13, based on the calculated distance of contact travel per page, the controller 18 further calculates a rotational distance traveled per minute by the pressure roller 4 in direct contact with the fuser belt 2. Such calculation may be performed by, for example, using the equation Eq. 2.

In step S14, the controller 18 refers to a lookup table which associates a specific rotational distance Y traveled per minute by the pressure roller 4 in direct contact with the fuser belt 2 with an optimal period of activation time during which the stepper motor 17 is activated to yield a corresponding amount of supply of the cleaning web 11 per each activation of the stepper motor 17.

In step S15, according to the lookup table, the controller 18 specifies a specific activation time with which to drive the stepper motor 17. Finally, in step S16, the controller 18 updates its associated memory with the specified activation time for driving the stepper motor 17, so as optimize the amount of supply of the cleaning web 11 according to the size and pickup cycle of the recording sheet S being used.

In further embodiment, the web cleaning system WC according to this patent specification can modify the amount of supply of the cleaning web 11 depending on the mode of operation in which each specific printing job is executed, which can influence the rate of usage of the cleaning web, as represented by the amount of contaminants collected by the cleaning web.

For example, during duplex printing, in which a recording medium has its first side printed initially and second side printed subsequently, the amount of toner collected by the cleaning web is typically greater than that observed during simplex printing. Such increase in the usage rate of the cleaning web is explained by the fact that where the duplex-printed sheet passes the fixing nip for processing the toner image printed on the second side, the pressure member collects toner not only from the fuser member, but also from the first printed side of the recording medium that directly contacts the pressure member at the fixing nip, resulting in an increased amount of toner present on the pressure member which is eventually wiped off by the cleaning web.

Further, during interleave duplex printing of multiple recording media, in which the fixing device initially processes the first sides of all the recording media in succession, and subsequently processes the second sides of all the recording media in succession, arranging multiple print jobs for increased efficiency results in enlarged page-to-page intervals at earlier and later stages of the successive processing, which eventually allows more offset toner to transfer from the fuser member to the pressure member than is experienced during normal duplex printing.

To maintain good imaging quality of the fixing device 60 without image defects due to soiling with offset toner or wasteful use of cleaning web, the controller 18 of the web cleaning system WC according to this patent specification can modify the amount of supply of the cleaning web 11 depending on whether printing is performed in a simplex mode, a normal duplex mode, or an interleave duplex mode, so as to provide reliable, efficient cleaning performance irrespective of a change in the operational mode influencing the rate of usage of the cleaning web.

Specifically, the controller 18 increases the amount of supply of the cleaning web 11 during duplex printing relative to that employed during simplex printing. In the present embodiment, for example, the controller 18 multiplies the activation time of the stepper motor 17 by a factor of 1.3 where the operational mode is switched from the simplex mode to the normal duplex mode.

Moreover, the controller 18 increases the amount of supply of the cleaning web 11 during interleave duplex printing relative to that employed during normal duplex printing. In the present embodiment, for example, the controller 18 increments the activation time of the stepper motor 17 by an increment of 0.5 seconds per each step of the motor where the operational mode is switched from the normal duplex mode to the interleave duplex mode, regardless of the size of recording sheet in use.

As is the case with the foregoing embodiment, a lookup table may be provided which associates a specific rotational distance traveled by the pressure roller 4 in direct contact with the fuser belt 2 with an optimal period of motor activation time, modified depending on whether printing is performed in the simplex mode, the normal duplex mode, or the interleave duplex mode. Table 3 below is an example of such lookup table in which the values for simplex printing presented in Table 2 are modified for the normal and interleave duplex printing.

TABLE 3

| Distance of contact travel per minute (mm) | Motor activation time (sec) | | |
|---|---|---|---|
| | Simplex mode | Normal duplex mode | Interleave duplex mode |
| $Y \leq 4600$ | 5 (default) | 6.5 | 7 |
| $4600 < Y \leq 6000$ | 6 | 7.8 | 8.3 |
| $6000 < Y \leq 8000$ | 7 | 9.1 | 9.6 |
| $8000 < Y \leq 10000$ | 8 | 10.4 | 10.9 |
| $10000 < Y$ | 9 | 11.7 | 12.2 |

In still further embodiment, the web cleaning system WC according to this patent specification can modify the amount of supply of the cleaning web 11 depending on the texture of recording medium in use, which can influence the rate of usage of the cleaning web, as represented by the amount of contaminants collected by the cleaning web.

For example, where printing is performed using coated paper, the pressure member tends to collect a smaller amount of toner particles than is observed where printing is performed using non-coated paper. This is because the coated paper, which has a relatively smooth surface, allows more heat to conduct to toner deposited thereon, and hence is less susceptible to toner offset than the non-coated paper.

To maintain good imaging quality of the fixing device 60 without image defects due to soiling with offset toner or wasteful use of cleaning web, the controller 18 of the web cleaning system WC according to this patent specification can modify the amount of supply of the cleaning web 11 depending on whether the recording sheet S in use is coated paper or non-coated paper, so as to provide reliable, efficient cleaning performance irrespective of a change in the type of recording sheet influencing the rate of usage of the cleaning web.

Specifically, the controller 18 decreases the amount of supply of the cleaning web 11 during printing on coated paper relative to that employed during printing on non-coated paper. In the present embodiment, for example, the controller 18 multiplies the activation time of the stepper motor 17 by a factor of 0.7 where the type of recording sheet S changes from non-coated paper to coated paper.

As is the case with the foregoing embodiment, a lookup table may be provided which associates a specific rotational distance traveled by the pressure roller 4 in direct contact with the fuser belt 2 with an optimal period of motor activation time, modified depending on whether the recording sheet S is coated paper or non-coated paper. Table 4 below is an example of such lookup table in which the values for printing on non-coated paper presented in Table 2 are modified for printing on coated paper.

TABLE 4

| Distance of contact travel per minute (mm) | Motor activation time (sec) | |
|---|---|---|
| | Non-coated paper | Coated paper |
| Y ≤ 4600 | 5 (default) | 3.5 |
| 4600 < Y ≤ 6000 | 6 | 4.2 |
| 6000 < Y ≤ 8000 | 7 | 4.9 |
| 8000 < Y ≤ 10000 | 8 | 5.6 |
| 10000 < Y | 9 | 6.3 |

Modifications to the amount of supply of the cleaning web 11 depending on the mode of operation in which each specific printing job is executed and depending on the texture of the recording sheet in use, as described above, may be performed alone or in combination with each other depending on the specific application of the fixing device 60.

In yet still further embodiment, the controller 18 of the web cleaning system WC according to this patent specification can modify the amount of supply of the cleaning web 11 depending on different, user-specified types of recording medium stored in its associated memory. In such cases, the controller 18 may adjust the period of motor activation time according to the lookup table which contains the optimal amount of supply of the cleaning web modified depending on a user-specified type of recording medium.

Such arrangement allows the controller 18 to properly optimize the amount of supply of the cleaning web 11 according to each specific print job submitted, thereby maintaining good image quality without image defects due to soiling with offset toner or wasteful use of cleaning web. For example, where a user submits a print job specifying a particular type of recording medium that has a relatively rough surface and is sized and/or oriented to be processed with a relatively long page-to-page distance, the controller 18 specifies a relatively long motor activation time to increase the supply of cleaning web for this specific print job.

In yet still further embodiment, the controller 18 of the web cleaning system WC according to this patent specification can modify the amount of supply of the cleaning web 11 as specified by a user for each print job. In such cases, the controller 18 is operatively connected with a user interface, such as a control panel provided on the image forming apparatus 100, which allows a user to specify a desired amount of supply of the cleaning web for input to the controller 18.

Such arrangement allows the controller 18 to properly optimize the amount of supply of the cleaning web 11 according to the user specification, even where the usage rate of the cleaning web 11 fluctuates with changes in environmental and operational conditions causing changes in the tendency of toner particles to offset from the recording medium, thereby maintaining good image quality without image defects due to soiling with offset toner or wasteful use of cleaning web.

To recapitulate, the fixing device is provided with a web cleaning system that cleans a pressure member of offset toner and other contaminants transferred from a fuser member, wherein the web cleaning system can appropriately control the supply of cleaning web depending on a rotational distance traveled by the pressure member in direct contact with the fuser member. Provision of the web cleaning system allows the fixing device to maintain reliable, high quality imaging performance without image defects due to soiling with offset toner particles, while preventing wasteful use of the cleaning web to reduce maintenance costs. The image forming apparatus incorporating the fixing device also benefits from those and other features of the web cleaning system according to this patent specification.

Although in several embodiments depicted above, the fixing device is depicted as including a fuser belt assembly formed of an endless, looped fuser belt paired with a pressure roller opposite the belt, alternatively, instead, the fixing device according to this patent specification may be applicable to any type of imaging system that includes a pair of opposed fixing members disposed opposite to each other to form a nip therebetween.

For example, the fixing device may be configured as a roller-based assembly that employs an internally heated roller paired with a pressure member opposite the roller, or as a pressure-belt assembly that employs an endless belt, instead of a roller, as a pressure member opposite a fuser member. Heaters employed in the fixing assembly may be of any heating element, such as a halogen heater, an electromagnetic induction heater, a resistive heater, a carbon heater, or the like.

Also, the image forming apparatus incorporating the fixing device may be configured otherwise than depicted herein. For example, the printer section may employ any number of imaging stations or primary colors associated therewith, e.g., a full-color process with three primary colors, a bi-color process with two primary colors, or a monochrome process with a single primary color. Further, instead of a tandem printing system, the printing section may employ any suitable imaging process for producing a toner image on a recording medium, such as one that employs a single photoconductor surrounded by multiple development devices for different primary colors, or one that employs a photoconductor in conjunction with a rotary or revolver development system rotatable relative to the photoconductive surface. Furthermore, the image forming apparatus according to this patent specification may be applicable to any type of electrophotographic imaging systems, such as photocopiers, printers, facsimiles, and multifunctional machines incorporating several of such imaging functions.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a rotary fuser member subjected to heating;

a rotary pressure member opposite the fuser member, the fuser member and the pressure member being pressed against each other to form a fixing nip therebetween through which a recording medium is conveyed as the fuser member and the pressure member rotate together; and a cleaning system to clean the pressure member, the cleaning system including:

a cleaning web at least partially contacting the pressure member to wipe the pressure member;

a web supply mechanism on which the cleaning web is mounted to be released into contact with the pressure member; and a controller operatively connected with the web supply mechanism to control an amount of supply of the cleaning web exclusively depending on a rotational distance traveled by the pressure member and the fuser member being in direct contact with each other.

2. The fixing device according to claim 1, wherein the controller calculates the rotational distance traveled by the pressure member in direct contact with the fuser member based on a length of the recording medium in a conveyance direction and a pickup cycle of the recording medium.

3. The fixing device according to claim 1, further comprising:

a sensor operatively connected with the controller and directed to a measurement point along a media conveyance path to signal the controller where the recording medium passes the measurement point, wherein the controller calculates the rotational distance traveled by the pressure member in direct contact with the fuser member based on the signal output from the sensor.

4. The fixing device according to claim 1, wherein the controller modifies the amount of supply of the cleaning web depending on whether printing is performed in a simplex mode or a duplex mode.

5. The fixing device according to claim 1, wherein the controller modifies the amount of supply of the cleaning web depending on whether printing is performed in a simplex mode, a normal duplex mode, or an interleave duplex mode.

6. The fixing device according to claim 1, wherein the controller modifies the amount of supply of the cleaning web depending on whether the recording medium in use is coated paper or non-coated paper.

7. The fixing device according to claim 1, further comprising:

a lookup table stored in the controller which associates a specific rotational distance traveled by the pressure member in direct contact with the fuser member with an optimal amount of supply of the cleaning web, wherein the controller refers to the lookup table to specify the amount of supply of the cleaning web.

8. The fixing device according to claim 7, wherein the lookup table contains an optimal amount of supply of the cleaning web modified depending on whether printing is performed in a simplex mode or a duplex mode.

9. The fixing device according to claim 7, wherein the lookup table contains an optimal amount of supply of the cleaning web modified depending on whether the recording medium is coated paper or non-coated paper.

10. The fixing device according to claim 7, wherein the lookup table contains an optimal amount of supply of the cleaning web modified depending on a user-specified type of recording medium.

11. The fixing device according to claim 1, further comprising:

a user interface connected to the controller to allow a user to specify a desired amount of supply of the cleaning web for input to the controller.

12. The fixing device according to claim 1, wherein the web supply mechanism includes:

a supply roller around which a new, unused length of cleaning web is wrapped and stored for future release;

a takeup roller to which a free, distal end of the cleaning web is attached;

a tension roller pressing against the pressure member to form a cleaning nip therebetween, through which the cleaning web is passed under pressure to rub against the pressure member; and a motor operatively connected with the takeup roller to rotate the takeup roller to in turn unreel the web from the supply roller.

13. The fixing device according to claim 12, wherein the controller is operatively connected to the motor to adjust a period of activation time during which the motor is activated to release the cleaning web, so as to control an amount by which the cleaning web is supplied to the cleaning nip upon each activation of the stepper motor.

14. The fixing device according to claim 1, wherein the rotational distance traveled by the pressure member in direct contact with the fuser member increases with a shorter length of the recording medium in a conveyance direction.

15. The fixing device according to claim 1, wherein an amount of contaminates collected by the cleaning web form the pressure member increase where printing is performed with a longer page-to-page distance, and decreases where printing is performed with a shorter page-to-page distance.

16. An image forming apparatus, comprising:

an electrophotographic imaging unit to form a toner image on a recording medium; and a fixing device to fix the toner image in place on the recording medium, the fixing device including:

a rotary fuser member subjected to heating;

a rotary pressure member opposite the fuser member, the fuser member and the pressure member being pressed against each other to form a fixing nip therebetween through which a recording medium is conveyed as the fuser member and the pressure member rotate together;

a cleaning web at least partially contacting the pressure member to wipe the pressure member;

a web supply mechanism on which the cleaning web is mounted to be released into contact with the pressure member; and a controller operatively connected with the web supply mechanism to control an amount of supply of the cleaning web exclusively depending on a rotational distance traveled by the pressure member and the fuser member being in direct contact with each other.

17. A cleaning system for use in a fixing device including a rotary fuser member subjected to heating and a rotary pressure member opposite the fuser member, the fuser member and the pressure member being pressed against each other to form a fixing nip therebetween through which a recording medium is conveyed as the fuser member and the pressure member rotate together, the cleaning system comprising:

a cleaning web at least partially contacting the pressure member to wipe the pressure member;

means for supplying the cleaning web by releasing it into contact with the pressure member; and means for controlling an amount of supply of the cleaning web exclusively depending on a rotational distance traveled by the pressure member and the fuser member being in direct contact with each other.

* * * * *